United States Patent [19]

Gill et al.

[11] 4,200,941

[45] May 6, 1980

[54] PULL-OUT SOFA BED AND HARDWARE THEREFOR

[75] Inventors: Glenn G. Gill, Bayonne, N.J.; Izchak Cycowicz, Brooklyn, N.Y.

[73] Assignee: Mohasco Corporation, Amsterdam, N.Y.

[21] Appl. No.: 894,194

[22] Filed: Apr. 6, 1978

[51] Int. Cl.[2] ..... A47C 17/14

[52] U.S. Cl. ..... 5/13; 5/29

[58] Field of Search ..... 5/13, 27, 29, 37, 55

[56] References Cited

U.S. PATENT DOCUMENTS 3,416,168 12/1968 Pokorny, Jr. ..... 5/13

3,984,883 10/1976 Wong ..... 5/13

4,035,852 7/1977 Cycowicz et al. ..... 5/13

*Primary Examiner*—Casmir A. Nunberg

*Attorney, Agent, or Firm*—Kirschstein, Kirschstein, Ottinger & Cobrin

[57] ABSTRACT

This pull out sofa bed is an improvement of the sofa bed disclosed in U.S. Pat. No. 3,984,883, granted Oct. 12, 1976. The change over the disclosure in said patent involves essentially several links different in figuration, and addition of a rivet. Primarily the change reduces the cost of manufacturing the bed with less material to accomplish the resulting operation. Also the spring actuated mechanism to retain the present bed in fully folded condition, was modified and allows for better closure of the bed.

5 Claims, 4 Drawing Figures

PULL-OUT SOFA BED AND HARDWARE THEREFOR

This invention relates to pull-out sofa beds and hardware therefor.

An object of this invention is to improve the bed disclosed in U.S. Pat. No. 3,984,883.

Another object of this invention is to provide a pull-out sofa bed of the character described which shall cost less to manufacture with less material and which shall yet accomplish the same resulting operation as with the bed dislcosed in said U.S. Pat. No. 3,984,883.

Another object of this invention is to provide a bed of the character described in which the slotted lock link 108 of U.S. Pat. No. 3,984,883 is replaced by a shorter hook lock link which is pivotally connected by a rivet to a rear leg link pivoted to the rear leg 45 of the patent. Said rivet slides in a longitudinal slot 114 in the right main angle 22 of the patent.

The resulting action is the same, with the difference that the mattress compression and lock is caused by a stop surface on the new hook lock link engaging the rivet rather than the end of the slot in the old slotted lock link.

Another object of this invention is to provide in a bed of the character described, a hook lock link which is slightly too long causing the rivet in the slot to jam against the front end of the slot in the main angle to produce a steadying effect on the bed.

Yet another object of this invention is to provide a strong and rugged bed of the character described which shall be relatively inexpensive to manufacture, easy to assemble and manipulate and which shall yet be practical and efficient to a high degree in use.

Other objects of this invention will in part be obvious and in part hereinafter pointed out.

The invention accordingly consists in the features of construction, combinations of elements, and arrangement of parts which will be exemplified in the product hereinafter described and of which the scope of invention will be indicated in the following claims.

Figure 1:
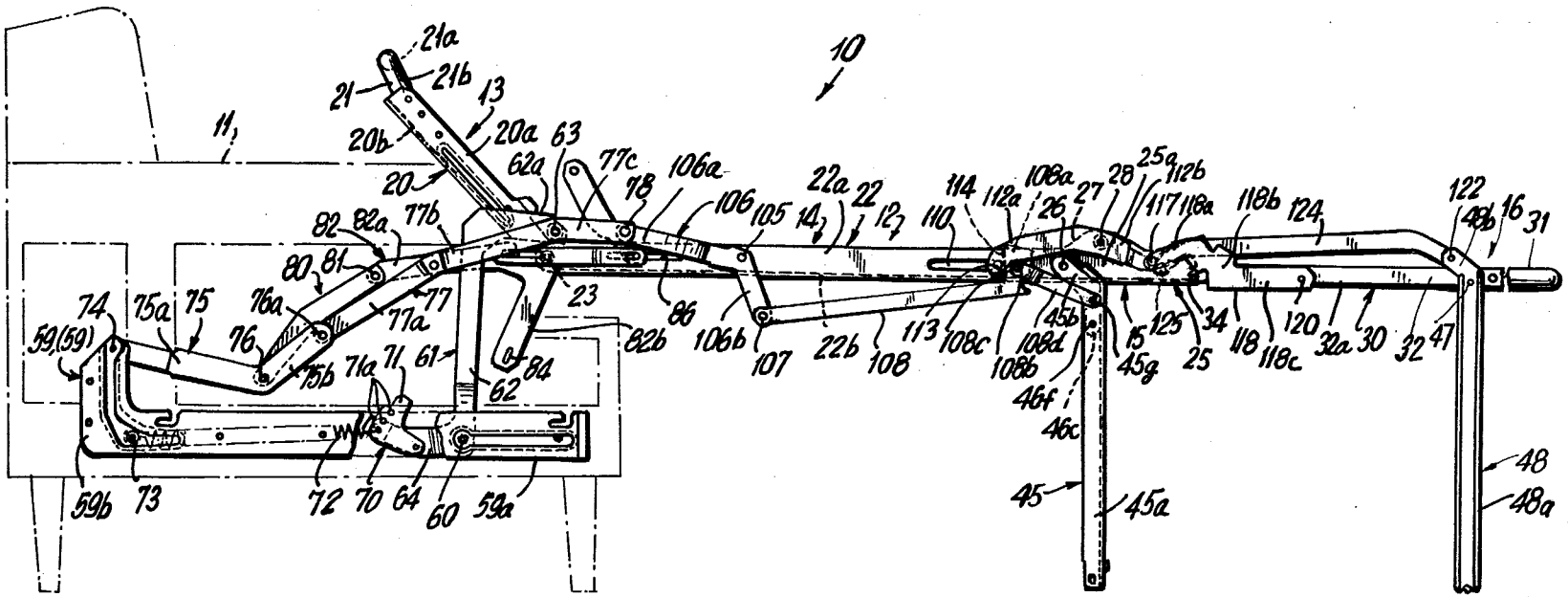
FIG. 1 is a side view of the bed in fully pulled out position.

Referring now in detail to the drawing, 10 designates a pull out sofa bed comprising a sofa bed wood frame 11 to which a metal foldable or collapsible bed 12 is connected.

Said bed 12 comprises a rear head or body frame section 13, a long intermediate or body frame section 14 pivotally connected at one end to said head section, a short intermediate or body frame section 15 pivotally connected at one end to the other end of said long intermediate section 14, and a front foot or body frame section 16 pivotally connected to the other end of said short intermediate section.

The head section 13 comprises left and right rear side angles 20 which are similar and symmetrically disposed, and interconnected by a T.V. end cross tube 21. The end tube 21 comprises a transverse tubular portion **21*a* from the ends of which short arms 21*b* extend. Said arms 21*b* are riveted to adjacent ends of the rear side angle 20. Each rear side angle 20 has a flange 20*a* extending upwardly from the outer end of an inwardly extending horizontal flange 20*b***.

Member 21 is made of tubular stock and its tubular arms **21*b* are each flattened into angular shape to form a vertical flange and a horizontal flange and which are interfitted with and riveted to adjacent ends of the vertical flange 20*a* and horizontal flange 20*b* of a rear side angle 20**.

The long intermediate section 14 comprises similar, symmetrically disposed left and right main angles 22, each having an outer vertical flange **22*a* extending up from an outer end of a lower inwardly extending horizontal flange 22*b*. The vertical flanges 20*a* are pivoted at their right ends by rivets 23 to the left ends of flanges 22*a***.

The short intermediate section 15 comprises left and right similar, symmetrically disposed center angles 25, each comprising a vertical outer upwardly extending flange **25*a* and a lower, inwardly extending horizontal flange. The right ends of flange 22*a* of the main angle 22, are hinged to the left ends of flanges 25*a* of the center angles 25, by pivot rivets or pins 26. Vertical flanges 25*a* have upward triangular extensions 27 rising above the level of the upper edges of flanges 22*a* and carry a pivot rivet or pin 28** at the apex of said extension, for the purpose hereinafter appearing.

The foot section 16 comprises a front member 30 of tubular stock, comprising an end tube portion 31 from which parallel tube portions 32 extend. The parallel tube portions 32 are compressed to form flattened vertical flanges **32*a* pivotally connected at their left ends to right ends of flanges 25*a* of the center angles by pivot pins or rivets 34. Portions 32 are horizontal when the bed is pulled out and in sleeping position, as shown in FIG. 1**.

The sections 13, 14, 15 and 16 together form a rectangular frame with curved corners, when the bed is fully pulled out. Attached to said frame is a linkage to form a usual platform or support for a mattress (not shown). The platform is connected to the frame in the usual manner to support the mattress.

Pivoted to pivot pins or rivets 26 are similar, symmetrically disposed rear legs 45 each having a long vertical portion **45*a* (when the bed is fully pulled out), and an upwardly and rearwardly inclined portion 45*b*, the upper end of which is pivoted to said pin 26. A rear leg patch 46*c* reinforces the upper end of leg 45. Patch 46*c* receives pivot 26 and is riveted to the rear leg as at 46*f***.

Pivoted to legs 32 of member 30 as on pivot pins or rivets 47 are similar symmetrically disposed front legs 48, each having a vertical long portion **48*a* (when the bed is fully pulled out) and a short upwardly and rearwardly inclined portion 48*b* at the upper end of portion 48*a***.

Figure 2:
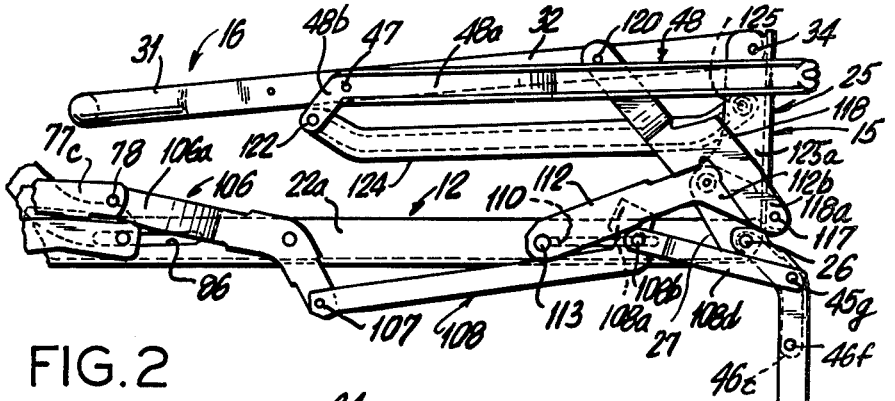
FIG. 2 is a partial view of the bed with the front section folded to a horizontal rearwardly projection position, disposed above the main angle.
Figure 3:
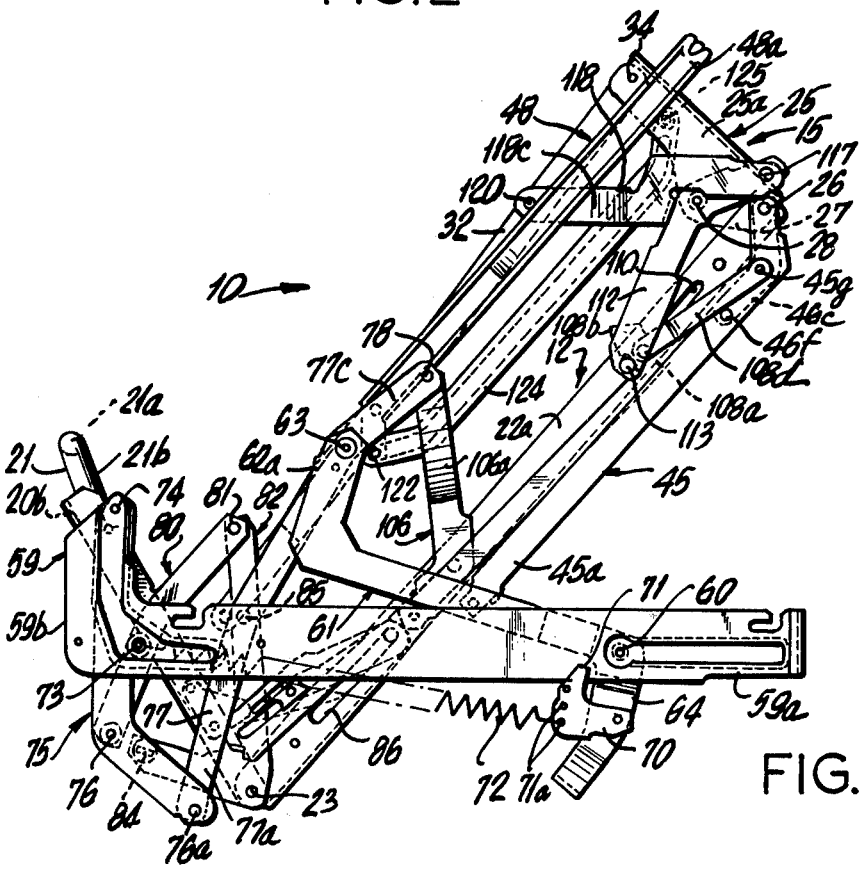
FIG. 3 is a view of the bed with the folded main section, intermediate section and front section inclined downwardly and rearwardly.
Figure 4:
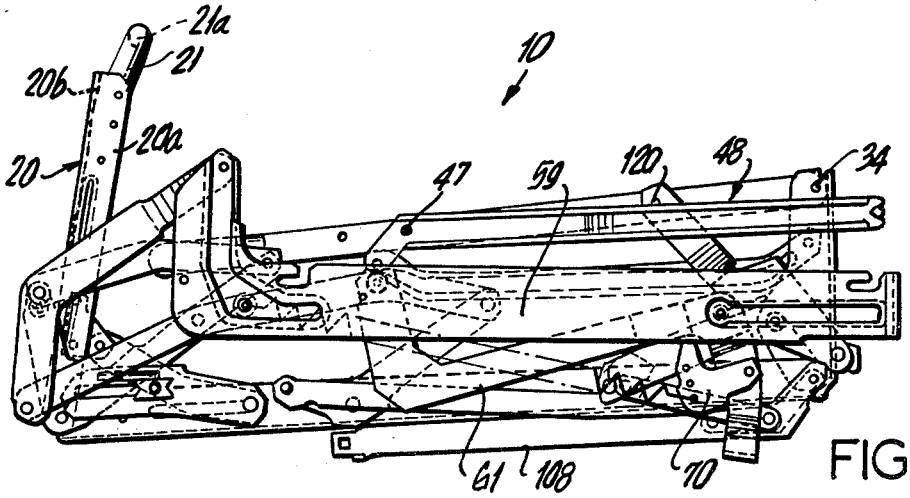
FIG. 4 is a fully collapsed position of the folded bed.

Rear linkage folding means is provided to connect the bed sections 13, 14, 15, 16 and the legs 45, 48 in such manner that the bed will be supported in pulled out or extended bed condition for sleeping, connected to a right chassis 59 and a left chassis 59, both fixed to the wood bed frame 11, and can be collapsed by first upfolding the foot section 16 through an angle of 90° to the dot-dash position of FIG. 1, then swinging the upfolded foot section 16 and the short intermediate section 15, together through an angle of 90° to position of FIG. 2 and then first moving the bed from the position of FIG. 2 to the position of FIG. 3 and then to fully collapsed sofa position of FIG. 4.

The chassis 59 on both sides of the bed are similar and symmetrically disposed. Since the means which connects the longitudinal portions of the bed frame on the right and left facing sides of the bed, are substantially similar and symmetrically disposed, only the connections on one side will be described. The side shown in FIGS. 1, 2, 3 and 4 is the left facing side of the bed, which is the side on the left side of a person standing in front of the foot end of the bed and looking toward the head end of the bed. The connections are shown when a person standing at the left facing side of the bed looks toward the outside of the left facing side of the bed.

The chassis 59 (FIG. 1) is in a vertical plane, and has a horizontally extending portion 59*a* from the left end of which a vertically extending portion 59*b* projects upwardly. Pivoted to portion 59*a* of the chassis, as at 60 is a main lever 61. The chassis can be fixed to the wood frame 11 in any suitable usual manner. Said lever 61 comprises an arm 62 extending up from pivot 60. Said arm 62 inclines upwardly and to the right (forwardly) as shown in FIG. 1, to a height above pivot 23, and carries a pivot pin or rivet 63 at its upper end. Extending from the lower end of arm 62 is an arm 64 which extends to the rear in the FIG. 1 (sleeping) position of the bed. Arm 62 has a forwardly extending upper end 62*a* which carries the pivot 63.

Pivoted to arm 64 is a tension link 70 having an upstanding arm 71 formed with a row of openings 71*a* extending lengthwise of the arm. A coil tension spring 72 connects a selected hole or opening 71*a* with an anchoring pin 73 on arm 59*b*. Spring 72 biases the main lever 61 to rotate in a clockwise direction (FIG. 1).

Pivoted to the upper end of arm 59*b* of chassis 59, as at 74, is a rear swing link 75 having an arm 75*a* inclined downwardly and forwardly as shown in FIG. 1, and an arm 75*b* inclined upwardly and forwardly from its junction with said arm 75*a*. At such junction is a pivot pin 76. Pivoted to the forward end of arm 75*b*, as at 76*a*, is a rear throwout link 77. Link 77 has a first straight arm 77*a* inclined upwardly and forwardly, a second straight arm 77*b* inclined upwardly and forwardly from the forward end of arm 77*a* but at a lesser angle to the horizontal. The forward end of arm 77*a* is pivoted at 63 to the arm 62*a*. Extending from the forward end of arm 77*b* is an arm 77*c* inclined slightly downwardly and forwardly and carrying a pivot pin 78 at its forward end disposed above angle 22 of the long intermediate section 14 of the bed.

Pivoted to pivot 76, at the junction of arms 75*a*, 75*b* of rear swing link 75 is one end of rear control link 80 which, as shown in FIG. 1, projects upwardly and forwardly and is located above pivot pin 76*a*. Pivoted to the forward end of link 80, as at 81 is a rear guide link 82 shaped like a bell crank and having a first arm 82*a* inclined slightly upwardly and extending forwardly, as shown in FIG. 1, and being pivoted to said pivot pin 23 and having a downwardly and rearwardly inclined arm 82*b*. The lower ends of the arms 82*b* on opposite sides of the bed may be interconnected by a cross tube 84.

Link 77 crosses link 82 at the junction of arms 77*a*, 77*b* of said link 77 and is pivoted to arms 82*a* of said link 82 where they cross, by pivot pin 85.

Means is provided to releasably retain the head section 20 in upwardly and rearwardly inclined position as shown and described in said U.S. Pat. No. 3,984,883. Such structure does not effect the invention disclosed herein and will not be described.

Pivoted to the flange 22*a* of main angle 22, as on pivot 105 (FIG. 1), is a main bellcrank 106 having a rearwardly and upwardly extending arm 106*a* pivoted to arm 77*c* of the rear throwout link 77 by said pivot pin 78. Said main bellcrank 106 also has a drive arm 106*b* projecting forwardly and more steeply downwardly as seen in FIG. 1, and carrying a pivot 107 at its lower end.

Pivoted to the pivot 107 is a hook lock link 108. At the right end of link 108 (FIG. 1) is an upward rearwardly hooked projection 108*a* carrying an anchor pin 108*b* slidably received in the rear end of a longitudinal slot 110 in flange 22*a* located near pin 26. Projection 108*a* has a rearwardly facing vertical edge 108*c* crossing the slot 110. Pin 108*b* is connected by a rear leg link 108*d* inclined downwardly and rearwardly, when the bed is open, as shown in FIG. 1. The front end of rear leg link 108*d* is connected to pin 45*g* at the upper end of portion 45*a* of the rear leg 45.

Pivoted to the pivot pin 28 on central angle 25, is a main lock link 112 having an arm 112*a* projecting rearwardly and downwardly, in the FIG. 1 position of the bed, and carrying at its rear end, a pin 113 slidable in slot 110.

The main lock link 112 has a forwardly and downwardly inclined arm 112*b* pivoted at its forward end by a pivot 117, to a front tube or foot section lock link 118. Link 118 is zig-zag in shape, having an arm 118*a* inclined upwardly somewhat and forwardly from the pivot 117. Extending from the forward end of arm 118*a* is an arm 118*c* projecting forwardly in offset relation to arm 118*a*. The right end of arm 118*c* is pivoted, as at 120, to arm 32 of tubular foot section 30.

At the upper end of arm 48*b* of the front leg 48 is a pivot 122 connected by a front leg link 124 to a pivot 125 on the center angle 25, lying between pivots 34 and 117 when the bed is in its fully extended position of FIG. 1.

In the FIG. 2 position of the bed, the mattress (not shown) is securely locked between the bed sections 14 and 16.

Lock pin 113 contacts the rear vertical edge or abutment surface 114 of projection 108*a*.

Briefly, the changes from U.S. Pat. No. 3,984,883 involves:

A. The hook lock link 108 replaces the slotted lock link 108 of the patent.

B. The rear leg link 111 of the patent is shortened and connected by pin 108*b* to a different point on the link 108 of this application.

C. The pin 108*b* of the application retains the new hook lock link in the slot 110 of the main angle 22 where formerly the slotted lock link and main locking link 112 were retained in the main angle 22 by a rivet 113 passing through two slots 110, 115.

The mattress compression and lock is caused, by a stop surface or edge 114 of the hook lock link 108 engaging the rivet or pivot 113 rather than the end of a slot as in the old slotted lock link of the patent.

A steadying effect is now achieved by the hook lock link being slightly too long causing pin 108*b* to jam against the end of the slot in the main angle.

As shown in FIG. 2, the foot section 16 has been folded upwardly 90° about pivot pin 34 to upstanding vertical position as shown in U.S. Pat. No. 3,984,833, FIG. 1, in dot-dash lines, with the front leg 48 swung against the foot section, and then the short intermediate section 15 was swung up 90° to upstanding vertical position and the foot section brought to horizontal position extending rearwardly in spaced relation above the long main section 14.

In such position pin 113 is at the left end of slot 110. Pin 113 is on link 112 which is pivoted at 117 to link 118, and keeps the foot section 16 down to compress the mattress (not shown) but located between bed sections 16, 15.

In such position, furthermore the projection 108*a* is spaced forwardly from pin 113.

In the FIG. 3 position of the bed, the rear leg 45 has been swung up against the underside of main bed section 15, causing rear leg link 108*d* to slide the projection 108*a* rearwardly in slot 110 to clamp pin 113 to the rear end of slot 110 to retain the foot section 16 in clamped condition against the mattress.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

I claim:

1. In a folding sofa-bed assembly of the type including at each side thereof:

(A) a primary body frame section having a longitudinally-extending slot bounded by a front slot wall and a rear slot wall;

(B) a secondary body frame section pivotally connecting its rear end region with the front end region of the primary section;

(C) a front foot section pivotally connecting its rear end region with the front end region of the secondary section;

(D) rear linkage folding means for moving the sections between an end-limiting collapsed sofa position, in which the foot section generally overlies at least a part of the primary section, and an end-limiting extended bed position, in which the foot section generally lies in a generally horizontal plane with the secondary section and with the primary section part, said rear linkage means having a drive arm pivotally mounted on one of the frame sections; and (E) a rear leg pivotally mounted on one of the frame sections for movement between a bed-supporting position and a collapsed position in response to operation of the rear linkage means;

the improvement at each side of the sofa-bed assembly comprising:

means for stabilizing the rear leg in its bed-supporting position, including (i) a hook lock link having a rear portion pivotally connected at a drive point to the drive arm, and a front portion on which a pivot anchor pin is mounted, said anchor pin being mounted for reciprocating sliding movement in the slot, said drive point being spaced from the front slot wall at a predetermined distance in the extended bed position, (ii) a rear leg support link having one end region pivotally mounted on said pin, and its opposite end region pivotally connected to the rear leg, and (iii) said hook lock link having an oversized length greater than said predetermined distance such that the anchor pin is forwardly urged into tight frictional jamming engagement with the front slot wall in the extended bed position, said anchor pin being fixedly anchored under tension by the oversized hook lock link at the front slot wall in the extended bed position to thereby fixedly anchor the rear leg support link and in turn the rear leg, whereby the rear leg is reliably supported in its bed-supporting position without excessive wobble.

2. The improvement as defined in claim 1; and further comprising lock link means for controlling the relative positions of the sections during the folding movement, said lock link means including a foot lock link pivotally mounted on the foot section, and a main lock link pivotally mounted on one of the frame sections, said main lock link having a front portion pivotally connected to the rear of the foot lock link, and a rear portion on which a lock pin is mounted, said lock pin being mounted for sliding reciprocating movement in the same slot as said anchor pin.

3. The improvement as defined in claim 2, wherein the lock pin frictionally engages a rear abutment surface of the front portion of the hook lock link in the extended bed position at a location which is intermediate the front slot wall and the rear slot wall, said lock pin serving as a stop and assisting the oversized hook lock link in preventing rearward movement of the anchor pin along the slot.

4. The improvement as defined in claim 1, wherein the opposite end region of the rear leg support link is pivotally connected to the rear leg at a location below the pivot connection between the frame sections.

5. Hardware for a folding sofa-bed assembly of the type including:

(A) a primary body frame section having a longitudinally-extending slot bounded by a front slot wall and a rear slot wall;

(B) a secondary body frame section pivotally connecting its rear end region with the front end region of the primary section;

(C) a front foot section pivotally connecting its rear end region with the front end region of the secondary section;

(D) rear linkage folding means for moving the sections between an end-limiting collapsed sofa position, in which the foot section generally overlies at least a part of the primary section, and an end-limiting extended bed position, in which the foot section generally lies in a generally horizontal plane with the secondary section and with the primary section part, said rear linkage means having a drive arm pivotally mounted on one of the frame sections; and (E) a rear leg pivotally mounted on one of the frame sections for movement between a bed-supporting position and a collapsed position in response to operation of the rear linkage means;

the improved hardware comprising:

means for stabilizing the rear leg in its bed-supporting position, including (i) a hook lock link having a rear portion pivotally connected at a drive point to the drive arm, and a front portion on which a pivot anchor pin is mounted, said anchor pin being mounted for reciprocating sliding movement with the slot, said drive point being spaced from the front slot wall at a predetermined distance in the extended bed position, (ii) a rear leg support link having one end region pivotally mounted on said pin, and its opposite end region pivotally connected to the rear leg, and (iii) said hook lock link having an oversized length greater than said predetermined distance such that the anchor pin is forwardly urged into tight frictional jamming engagement with the front slot wall in the extended bed position, said anchor pin being fixedly anchored under tension by the oversized hook lock link at the front slot wall in the extended bed position to thereby fixedly anchor the rear leg support link and in turn the rear leg, whereby the rear leg is reliably supported in its bed-supporting position without excessive wobble.

* * * * *